US008214960B1

(12) United States Patent
Rupp

(10) Patent No.: US 8,214,960 B1
(45) Date of Patent: Jul. 10, 2012

(54) FLOOR SWEEPER

(75) Inventor: Mark N. Rupp, Delaware, OH (US)

(73) Assignee: NSS Enterprises, Inc., Toledo, OH (US)

( * ) Notice: Subject to any disclaimer, the term of this patent is extended or adjusted under 35 U.S.C. 154(b) by 503 days.

(21) Appl. No.: 12/462,994

(22) Filed: Aug. 12, 2009

Related U.S. Application Data

(60) Provisional application No. 61/089,967, filed on Aug. 19, 2008.

(51) Int. Cl.
*A47L 11/32* (2006.01)

(52) U.S. Cl. ..... 15/41.1; 15/79.1; 15/80

(58) Field of Classification Search ..... 15/41.1, 15/79.1, 79.2, 80, 49.1
See application file for complete search history.

(56) References Cited

U.S. PATENT DOCUMENTS

| | | | | |
|---|---|---|---|---|
| 2,268,059 | A | 12/1941 | Parker et al. | |
| D161,681 | S | 1/1951 | Dreyfuss | |
| 3,950,809 | A | 4/1976 | Schatzmann | |
| 4,325,156 | A | 4/1982 | Rosendall | |
| 4,357,730 | A | 11/1982 | Lex | |
| 4,366,593 | A * | 1/1983 | Parikh | 15/52.1 |
| 4,419,784 | A | 12/1983 | Lex | |
| 4,426,751 | A | 1/1984 | Nordeen | |
| 4,654,927 | A | 4/1987 | Novinger | |
| 4,701,969 | A | 10/1987 | Berfield et al. | |
| 4,709,436 | A | 12/1987 | Berfield et al. | |
| 4,823,153 | A | 4/1989 | Coburn | |
| 4,845,797 | A | 7/1989 | Kobayashi | |
| 4,850,077 | A | 7/1989 | Venturini | |
| 5,077,862 | A | 1/1992 | Rench | |
| 5,077,863 | A | 1/1992 | Rench | |
| 5,086,539 | A | 2/1992 | Rench | |
| 5,208,935 | A | 5/1993 | Jailor et al. | |
| 5,485,653 | A | 1/1996 | Knowlton et al. | |
| 5,564,161 | A | 10/1996 | Glatz | |
| 5,867,864 | A | 2/1999 | Miller et al. | |
| 5,970,558 | A | 10/1999 | Canavan et al. | |
| 6,009,594 | A | 1/2000 | Grey | |
| 6,574,828 | B2 | 6/2003 | Hile | |
| 6,735,812 | B2 | 5/2004 | Hekman et al. | |
| 6,862,775 | B2 | 3/2005 | Albert et al. | |
| 6,915,544 | B2 | 7/2005 | Roney et al. | |
| 6,918,155 | B2 | 7/2005 | Yacobi | |
| 2009/0229075 | A1 * | 9/2009 | Eriksson | 15/383 |

FOREIGN PATENT DOCUMENTS

| | | | |
|---|---|---|---|
| DE | 2845212 | A1 | 10/1979 |
| NL | 9200276 | A | 9/1992 |

* cited by examiner

*Primary Examiner* — Shay Karls
(74) *Attorney, Agent, or Firm* — Marshall & Melhorn LLC

(57) ABSTRACT

A floor sweeper is disclosed having a removable debris compartment. The compartment has a front portion that is at least partially open. A pair of counter-rotating brushes are located forward of the debris compartment for delivering debris directly through the front portion into the debris compartment. A cover that strips debris from the brushes and that also directs stripped debris extends over the brushes. The cover has an air spoiler forward of the brushes. A strip for blocking debris is located opposite of the cover and is located substantially entirely the length of and between the brushes.

11 Claims, 4 Drawing Sheets

FLOOR SWEEPER

RELATED APPLICATIONS

This application claims the benefit of U.S. Provisional Application No. 61/089,967, filed Aug. 19, 2008, which is fully incorporated by reference herein.

FIELD OF THE INVENTION

The present invention relates to a floor sweeper that is effective on a variety of different floor types and a variety of different floor materials.

BACKGROUND OF THE INVENTION

Floor sweepers are well-known devices capable of sweeping debris from the floor into the sweeper resulting in a cleaner floor. The floor debris, having been collected within the sweeper, can then be disposed of from this convenient single location.

Floor sweepers often have brushes used to collect the debris from the floor. The brushes may be electrically powered, via connection to an outlet or by batteries. The brushes may also be rotated manually by virtue of the sweeper being pushed across the floor by an operator.

Battery powered sweepers are well-known products, with many examples available for the consumer market, and a smaller number of sweepers available for the commercial market. However, all of the available consumer and commercial products have performance limitations.

For example, the available sweepers all lack the ability to effectively pick up debris on both hard floors as well as carpeted floors. Those skilled in the art know that debris collection on carpeted floors is relatively easy, but the prior art sweepers are plagued by a number of problems when used on hard floors.

On hard floors, the prior art sweepers disadvantageously blow and scatter light debris forward, behind and/or to the sides and away from the sweeper. Additionally, these sweepers cannot pick up small and/or light debris, such as small amounts of fine sand and/or debris such as "hole punch dots" and similar debris.

In view of the disadvantages of the prior art designs, a sweeper that does not blow debris away from the sweeper and that is capable of picking up small and light debris on any surface is required.

SUMMARY OF THE INVENTION

In one embodiment of the invention a floor sweeper is provided comprising a removable debris compartment having a front portion that is at least partially open. A pair of counter-rotating brushes are located forward of the debris compartment for delivering debris directly through the front portion into the debris compartment. A cover is provided for stripping debris and directing debris from the brushes. The cover may have an air spoiler forward of the brushes. A debris blocking strip may be located opposite of the cover and extend substantially the entire length of the brushes.

BRIEF DESCRIPTION OF THE DRAWINGS

The above advantages of the present invention will become readily apparent to those skilled in the art from the following detailed description when considered in the light of the accompanying drawings in which.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined herein. Hence, specific dimensions, directions or other physical characteristics relating to the embodiments disclosed are not to be considered as limiting, unless the expressly stated otherwise.

Figure 1:
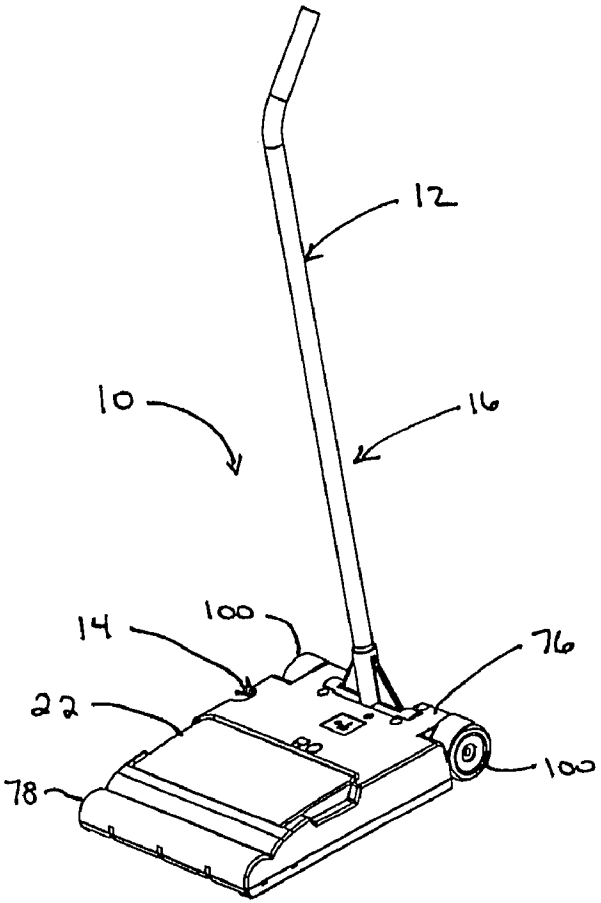
FIG. 1 is a schematic perspective view of one embodiment of the present invention.

Turning now to FIG. 1, one construction embodying a sweeper 10 of the present invention comprising a handle portion 12 and a base portion 14 is depicted. The handle portion 12 is pivotally attached to the base portion 14 to permit the handle portion to be selectively angled with respect to the base portion 14.

In FIG. 1, the handle portion 12 is depicted in what will be referred to as a stowed position 16. The stowed position 16 is a position in which the handle portion 12 is approximately perpendicular to the base portion 14. When the handle portion 12 is in the stowed position 16, the sweeper 10 is typically not in use. When the handle portion 12 is pivoted from the stowed position 16 rearwardly with respect to the base portion 14, the handle portion 12 is in a use position (not shown).

An electrical switch (not shown), located in the base portion 14, is connected to the handle portion 12. The switch is connected to the handle portion 12 so that when the handle portion 12 is in the stowed position 16, the switch is in the off position. When the handle portion 12 is moved from the stowed position 16, the switch is turned on. The angle, with respect to the base portion 14, that the handle portion 12 turns the switch on and off can be varied. A hand operated switch on the handle portion 12 may also be utilized.

Figure 2:
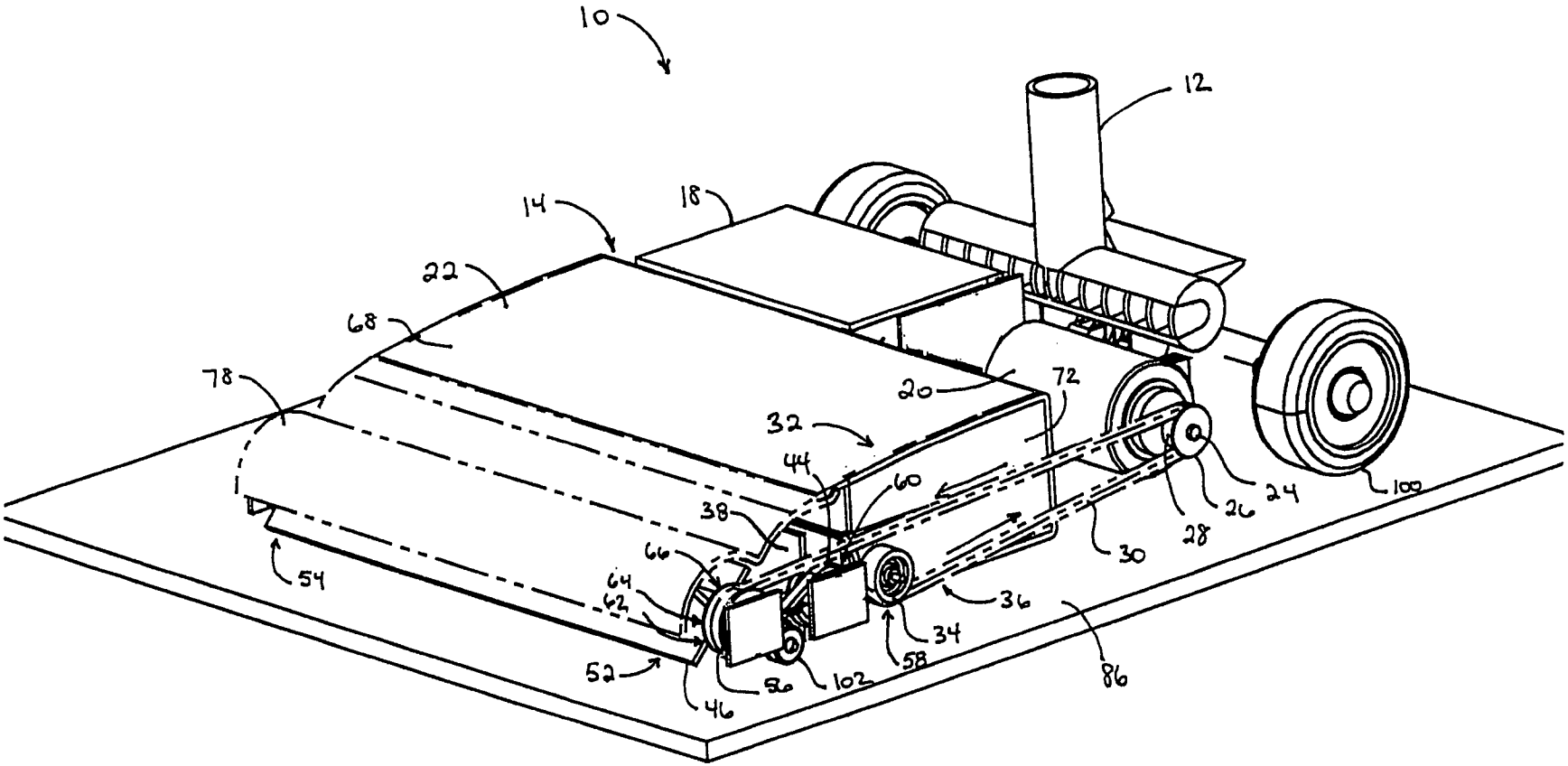
FIG. 2 is a schematic perspective view of a portion of the invention of FIG. 1 with a cover removed.

The electrical switch is connected between a battery 18 and a motor 20 in the base portion 14. The battery 18 is preferably located adjacent the motor 20 as shown in FIG. 2. More preferably, the battery 18 is located between the handle portion 12, the motor 20 and a debris compartment 22 that will be described in more detail below.

The battery 18 may be removably mounted in the base portion 14 to permit convenient replacement and repair. Regarding replacement, the battery 18 is preferably a rechargeable-type battery 18 that may be recharged in a separate charging unit (not shown). Thus, it can be appreciated that it may be desirable for multiple batteries to be on hand when operating the sweeper 10; one in the sweeper 10 itself and one or more in the separate charging units.

The motor 20 is located between the handle portion 12 and the debris compartment 22 and beside the battery 18. The motor 20 has a drive shaft 24 with a drive wheel 26 secured to the shaft 24. The drive shaft 24 preferably extends in an outboard direction with respect to the base portion 14. The drive wheel 26 may have a groove 28 in it for receiving a belt 30.

The belt 30 is preferably a closed loop-type belt 30. It may be constructed of any elastomer-like material with a high degree of durability.

The belt 30 extends forward from the motor 20 along an outboard portion 32 of the debris compartment 22. The belt 30 engages with a tensioning wheel 34 adjacent a lower forward portion 36 of the debris compartment 22. The tensioning wheel 34 is substantially aligned with the drive wheel 26. The tensioning wheel 34 permits a predetermined amount of tension to be provided in the belt 30.

Immediately forward of the debris compartment 22 is a rear rotating brush 38. The rear brush 38 is comprised of a tubular central section 40 with a plurality of brushes 42 extending substantially perpendicularly from the central section 40. Each of the brushes 42 extends from the central section 40 in a line such that a single brush 42 preferably extends substantially from a first end (not shown) of the rear brush 38 to a second end (not shown) of the rear brush 38.

A driven wheel 44 is located on the first end of the rear brush 38 and it is substantially aligned with the tensioning wheel 34. The driven wheel 44 is attached to the rear brush 38 such that when the wheel 44 is rotated, it rotates the central section 40 and the brush 38 as well.

Forward of the rear brush 38 is a forward brush 46. The forward brush 46 may have an identical tubular center section 48 and a plurality of brushes 50 as compared to the rear brush 38. Alternatively, the number of brushes and/or the pattern of the brushes may be different than the number and pattern of brushes for the rear brush 38.

The center section 48 of the forward brush 46 has a first end 52 and a second end 54. The first end has a driven wheel 56 secured thereto. The driven wheel 56 is aligned with the driven wheel 44 on the rear brush 38.

Preferably, the belt 30 is in contact with a lower portion 58 of the tensioning wheel 34. From the lower portion 58 of the tensioning wheel 34, the belt 30 extends upwardly to extend over an upper portion 60 of the rear brush driven wheel 44. From the rear brush driven wheel 44, the belt 30 extends downwardly to initially engage a lower portion 62 of the driven wheel 56 of the forward brush 46. The belt 30 extends around a forward portion 64 of the forward brush driven wheel 56 to an upper portion 66 of the wheel 56. From the forward portion 64 of the forward brush driven wheel 56, the belt 30 returns to the drive wheel 26 on the motor 20.

The motor 20 rotates the belt 30 in the direction of the arrow shown on FIG. 2. It can be appreciated that the depicted belt rotation results in the rear brush 38 rotating in a first direction and the forward brush 46 rotates in a second, opposite direction. Preferably, the forward brush 46 rotates in a counterclockwise motion as seen from FIG. 2, while the rear brush rotates in a clockwise motion, also as seen from FIG. 2. While clock rotation directions of the brushes 35, 46 have been mentioned above, the brushes 38, 46 of the present invention can rotate in the opposite directions. Preferably, however, regardless of the specific clock direction of rotation, the brushes 38, 46 rotate in opposite directions from one another.

While a belt 30 drive has been described and is depicted in the figures, it is within the scope of the invention to drive the forward and rear brush 38, 46 via one or more gears (not shown) connected to the motor 20. It is also within the scope of the invention to use a combination of gears and a belt (neither of which are shown) to drive the brushes 38, 46.

Figure 3:
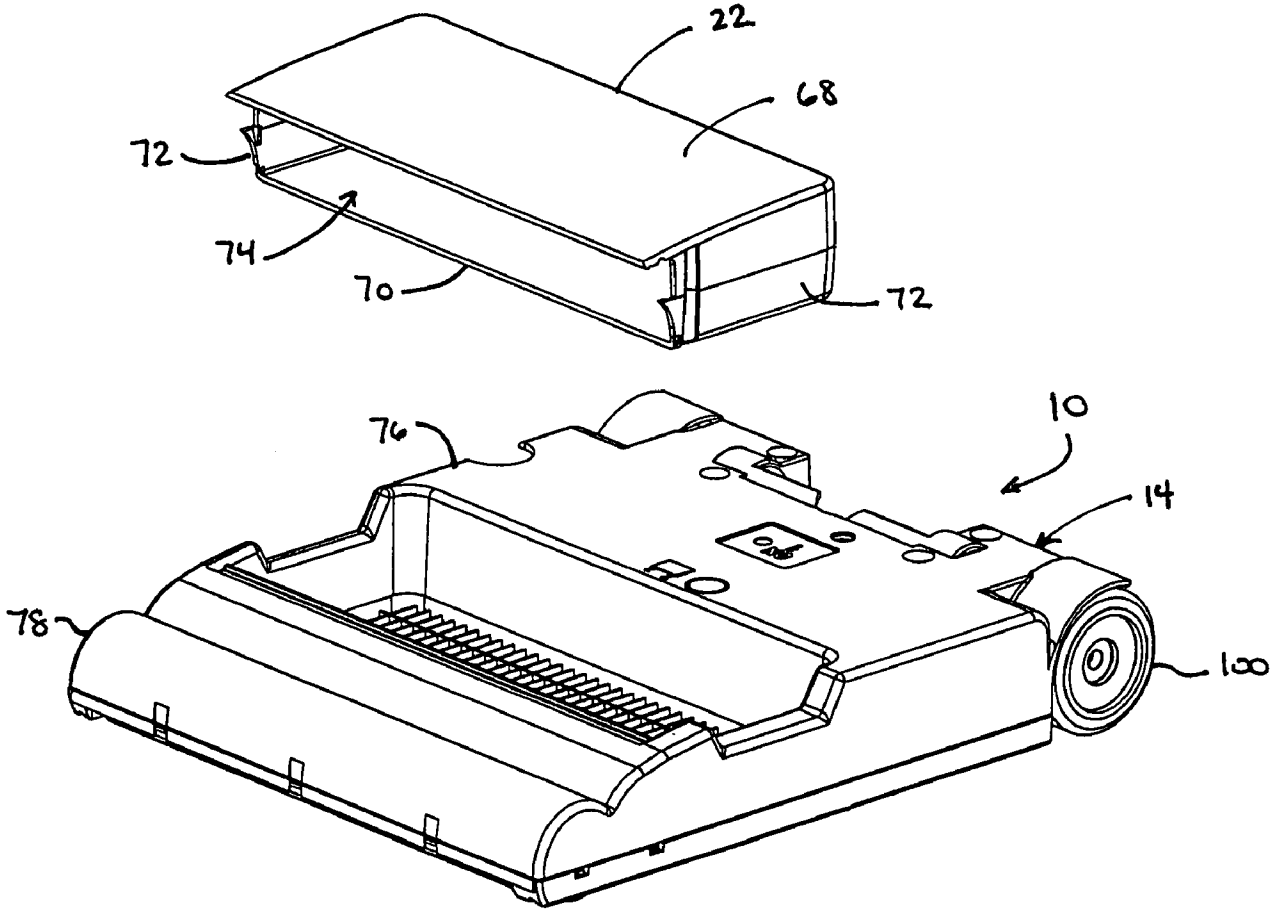
FIG. 3 is a schematic perspective view of the device of FIG. 2 with the cover in place and a debris compartment exploded from the sweeper.

FIGS. 1, 2 and 3 depict one embodiment of the debris compartment 22, but other shapes and sizes are within the scope of the invention. The debris compartment 22 is preferably located immediately behind the rear brush 38 and forward of the motor 20 and battery 18. The debris compartment 22 has an upper portion 68, a lower portion 70, side portions 72 and a front portion 74. The entire length of the front portion 74, from the upper portion 68 to the lower portion 70, is preferably open to receive debris from the brushes 38, 46. The portions 68, 70 and 72 form a box-like structure for temporarily storing debris.

Debris collected by the brushes 38, 46 remains within the compartment 22 for temporary storage. The debris compartment 22 is selectively removable from the sweeper 10 for maintenance, repair, replacement and emptying.

More specifically, the debris compartment 22 is designed to be located within, and removed from, the base portion 14 of the sweeper 10 without any tools or bolts, screws or the like. Effectively, the debris compartment 22 drops in a portion of the base portion 14 having a complimentary shape to the compartment 22. It can be picked up and removed just as easily from the base portion 14. The ease at which the debris compartment 22 can be located within and removed from the base portion 14 facilitates effortless and quick emptying.

A housing 76 covers the sweeper 10 preferably in conjunction with the debris compartment 22. The housing 76 may be of a one-piece construction or it may be comprised of multiple pieces. Preferably, the housing 76 covers the motor 20, the battery 18, belt 30 and the drive and driven wheels, 26, 44, 56 as well as the brushes 38, 46.

The housing 76 comprises a brush cover 78. The brush cover 78 preferably covers at least the forward brush 46 and it may cover, as shown in the figures, the rear brush 38 as well. The portion of the brush cover 78 located over the brushes 38, 46 has at least three functions.

First, the brush cover 78 functions as a housing to protect the brushes 38, 46, prevent items from falling into the brushes 38, 46 from above and it provides an aesthetically pleasing cover over the brushes 38, 46.

Second, the brush cover 78 is designed to fit closely to the forward brush 46. By locating the cover 78 in close proximity to the forward brush 46, the cover 78 is able to strip debris from the sets of brushes 50 on the forward brush 46 as they pass beneath it.

It is preferable to strip the debris from the forward brush 46 to minimize the chance that the brush 46 will become clogged. A brush 46 clogged with debris is undesirable at least for the reasons that the brush 46 loses its ability to pick up new debris on the floor and it may result in debris scattering from the brush 46 on to the floor.

Preferably, a bottom surface 80 of the cover 78 is located between approximately 0.01 inches and approximately 0.1 inches from an outside diameter 82 of brushes 50 on the forward brush 46. More preferably, the bottom surface 80 of the cover 78 is located approximately 0.060 inches from the outside diameter 82 of the brushes 50 on the forward brush 46.

The third function of the housing 76 is to direct the debris that has been stripped from the forward brush 46 into the rotating brushes 42 of the rear brush 38. The rear brush 38, rotating in an opposite direction of the forward brush 46, then directs the debris into the open, forward portion 64 of the debris compartment 22.

A brush strip 84 is preferably located between the two rotating brushes 38, 46. The brush strip 84 is a relatively thin, in terms of width, strip of material, such as plastic or metal, that is located substantially entirely between the brushes 38, 46 and substantially perpendicular to a floor surface 86. An upper end portion 88 of the strip 84 is secured between the brushes 38, 46 while a lower end portion 90 extends downwardly toward, and may be in contact with, the floor 86. Preferably, the strip 84 extends downwardly below the outer diameter of the brushes 38, 46. The strip 84 can extend between the entire length of the brushes 38, 46, or it can extend only selectively between the brushes 38, 46.

The brush strip blocks 84 rearwardly travelling debris from the forward brush 46 from being propelled behind the sweeper 10. The brush strip 84 also blocks forwardly travelling debris from the rear brush 38 from being propelled in front of the sweeper 10.

Figure 4:
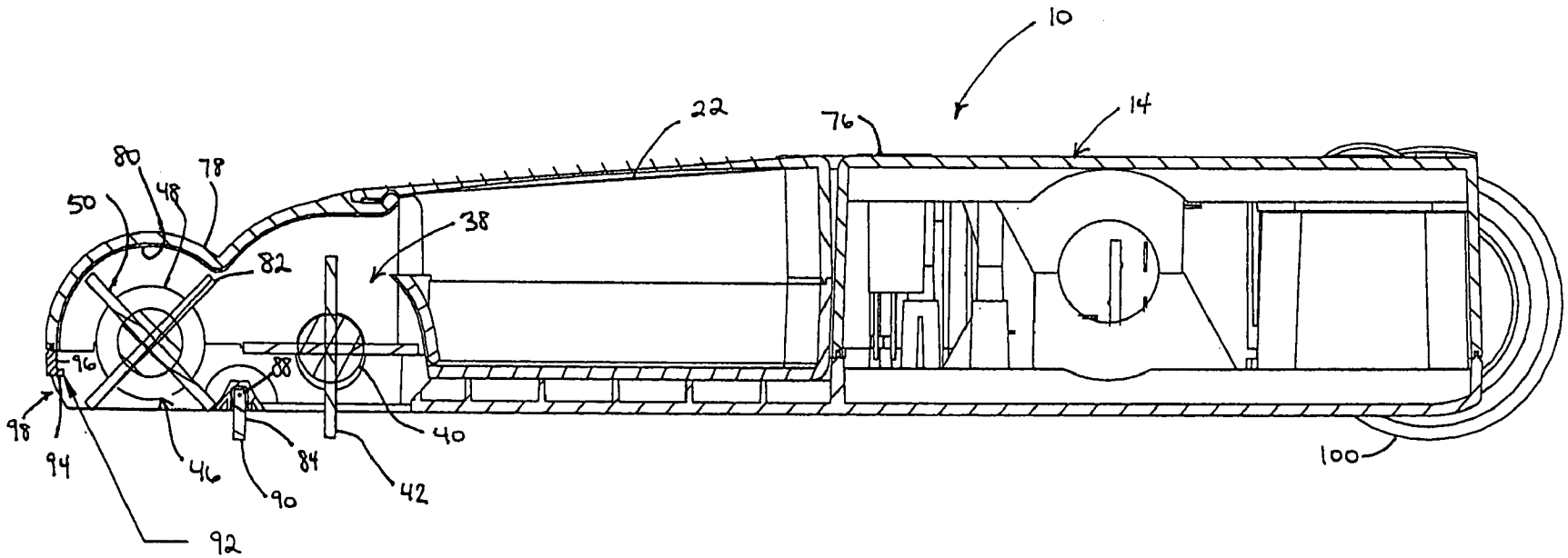
FIG. 4 is a schematic cutaway side view of the device depicted in the foregoing figures.

A spoiler 92 is preferably located forward of the forward brush 46, as shown in FIG. 4. The spoiler 92 may be located on the brush cover 78. The spoiler 92 may be integrally formed with the brush cover 78 or it may be separately attached to the cover 78.

The spoiler 92 is designed to modify an area of high pressure air that is generated in front of the sweeper 10 when the brushes 38, 46, and in particular the forward brush 46, rotate. More specifically, the spoiler 92 is designed to reduce or minimize the region of high pressure.

The rotating forward brush 46 moves air outward from the outer diameter of the brush bristles 50, in a generally tangential direction. This air, which is the result of a pressure differential measured from an area immediately surrounding the brush 46 to an area some distance away from the brush 46, tends to push light debris, such as dust, away from the sweeper 10.

The spoiler 92 extends into the stream of air from the brush 46 to disrupt the stream. By disrupting the airstream, the ability of the airstream to push debris, and in particular light debris, away from the sweeper 10 is greatly diminished, if not eliminated. It can be appreciated that debris which is desired to be collected can thereby be readily collected by the sweeper 10, instead of being blown ahead of or generally away from the sweeper 10.

A first portion 94 of the spoiler 92 preferably extends inwardly from the housing 76 toward the forward brush 46 and it is substantially parallel to the floor 86. The amount by which the spoiler 92 may extend from the housing 76 may vary, however, lengths ranging between approximately 0.1 and approximately 0.2 inches have been found to be effective.

A second portion 96 of the spoiler 92 may also be used to reduce an opening 98 between the housing 76 and the floor 86 to a dimension that permits appropriately large debris to enter the sweeper 10, but which is small enough to reduce or effectively eliminate debris moving air flow from the forward brush 46. The opening 98 may be between approximately 0.250 inches and approximately 0.9 inches. An opening 98 of approximately 0.625 inches has been found to be particularly advantageous, however, an opening of other dimensions may be used.

The base portion 14 is supported on a plurality of wheels. A first set of wheels 100 is preferably located rearward of the battery 18 and the motor 20. A second set of wheels 102 is preferably located between the forward brush 46 and the rear brush 38. The wheels 100, 102 permit the sweeper 10 to roll over a floor surface 86, including most known manmade and natural flooring materials, at a height predetermined to be effective for the forward and the rear brushes 46, 38 to collect debris from the floor surface 86.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. A floor sweeper, comprising:

a removable debris compartment having a front portion at least partially open;

a pair of counter-rotating brushes forward of said debris compartment for delivering debris directly through said front portion into said debris compartment;

a cover for stripping debris from said brushes and for directing debris into said compartment extends at least over said brushes, said cover having an air spoiler forward of said brushes; and a stationary debris blocking strip located opposite said cover and substantially entirely the length of and between said brushes, said strip having an upper portion secured between said brushes and a lower portion extending downwardly below an outer diameter of said brushes, wherein at least one permanent gap separates said debris blocking strip from said brushes.

2. The sweeper of claim 1, further comprising a motor located rearward said debris compartment.

3. The sweeper of claim 2, wherein said motor is connected to said counter-rotating brushes via a single continuous belt extending over a tension wheel, a first brush driven wheel and a second brush driven wheel, said first and second brush driven wheels being aligned with one another on ends of said brushes.

4. The sweeper of claim 1, wherein a forward brush of said pair rotates in a counterclockwise direction and a rear brush of said pair, located directly in front of said debris compartment, rotates in a clockwise direction.

5. The sweeper of claim 4, wherein said air spoiler has one portion that extends into a gap between said cover and a floor surface and another portion that extends tangentially toward said forward brush from said one portion.

6. The sweeper of claim 5, wherein said air spoiler is integrally formed with said cover.

7. The sweeper of claim 6, wherein said air spoiler reduces a high pressure region forward of said forward brush.

8. The sweeper of claim 1, wherein said cover is located 0.01 to 0.1 inches from an outer diameter of said forward brush.

9. The sweeper of claim 1, wherein said debris blocking strip has an upper portion secured between said pair of brushes and a lower portion adjacent a floor surface, said strip extends substantially perpendicularly to said floor surface.

10. The sweeper of claim 1, wherein the front portion of the debris compartment extends substantially the length of said pair of brushes.

11. A floor sweeper, comprising:

a forward brush rotating in a counterclockwise direction;

a rear brush, located directly behind said forward brush, and rotating in a clockwise direction;

a single continuous belt simultaneously rotating both of said brushes;

a cover extending over said brushes and said belt;

a high pressure reducing air spoiler extending from said cover in front of said forward brush; and a downwardly extending, stationary debris blocking strip located between said brushes, wherein permanent gaps separate said strip from said brushes.

* * * * *